US006409609B1

(12) United States Patent
Brezic

(10) Patent No.: US 6,409,609 B1
(45) Date of Patent: Jun. 25, 2002

(54) GOLF BALL EJECTOR

(75) Inventor: Richard F. Brezic, Bratenahl, OH (US)

(73) Assignee: McDivot Novelties, Inc., Cleveland, OH (US)

( * ) Notice: Subject to any disclaimer, the term of this patent is extended or adjusted under 35 U.S.C. 154(b) by 22 days.

(21) Appl. No.: 09/659,514

(22) Filed: Sep. 11, 2000

(51) Int. Cl.[7] ..... A63B 57/00
(52) U.S. Cl. ..... 473/177
(58) Field of Search ..... 473/177, 178, 473/182, 183; 273/125 R

(56) References Cited

U.S. PATENT DOCUMENTS

| | | | | | |
|---|---|---|---|---|---|
| 1,723,547 | A | * | 8/1929 | Hart | 473/177 |
| 1,776,161 | A | * | 9/1930 | Lockwood | 473/177 |
| 1,826,641 | A | * | 10/1931 | Waddell | 473/177 |
| 1,918,994 | A | * | 7/1933 | Stutz | 473/177 |
| 2,596,682 | A | * | 5/1952 | Hartung | 473/182 |
| 2,653,815 | A | * | 9/1953 | Hartung | 473/182 |
| 3,623,732 | A | | 11/1971 | Peeples | |
| 3,790,166 | A | * | 2/1974 | Hamilton | 473/177 |
| 3,792,861 | A | | 2/1974 | Coleman | |
| 3,874,665 | A | | 4/1975 | McCulloch et al. | |
| 3,897,059 | A | | 7/1975 | McCulloch et al. | |
| 4,290,603 | A | | 9/1981 | Barnes | |
| 4,496,150 | A | * | 1/1985 | McGlew | 473/177 |
| 4,552,358 | A | | 11/1985 | McGlew | |
| 4,563,009 | A | * | 1/1986 | Nagasaki et al. | 473/183 |
| 5,018,730 | A | | 5/1991 | Iliuta | |
| 5,393,053 | A | | 2/1995 | Wiese et al. | |
| 5,674,131 | A | | 10/1997 | Forbes et al. | |
| 5,685,780 | A | * | 11/1997 | Desjardins | 473/178 |
| 5,890,967 | A | | 4/1999 | Allen | |

* cited by examiner

*Primary Examiner*—Mark S. Graham
(74) *Attorney, Agent, or Firm*—Vickers, Daniels & Young

(57) ABSTRACT

A novelty golf ball ejector for ejecting a golf ball from a golf course cup with a cylindrical side wall, a top opening and a bottom portion with a centered hole. The golf ball ejector comprising a base plate having a top surface for guiding the golf ball onto an ejector plate, the ejector plate being pivotally interengaged with the base plate for ejecting the golf ball out of the top opening of the cup when the golf ball is in a ejection position on the ejector plate. The golf ball ejector further including an activator for actuating the ejector plate.

44 Claims, 3 Drawing Sheets

GOLF BALL EJECTOR

The present invention is directed to a golf ball ejector and, more particularly, to a novelty golf ball ejector for a golf ball cup which will eject the golf ball out of the golf cup in a selected direction in response to the golf ball falling into the cup.

BACKGROUND OF THE INVENTION

It is, of course, well known in the art that a golf ball can be ejected out of a golf cup for either preventing a golfer from bending to reach the golf ball within the cup or as a prank performed on another golfer. These devices use either spring forces or electrically generated forces to urge the golf ball out of the top opening of the golf cup in response to activation of the device. The difference between an ejector used to prevent the golfer from bending and a novelty ejector is typically associated with the way in which the device is activated. An ejector used to prevent bending is a greater convenience if it is activated when the golfer is in position to retrieve the ball. Conversely, a novelty ejector is not intended for convenience and, therefore, activation is not based on the location of the golfer. In this respect, pranks such as golf ball ejectors can be used to make a golfer believe they missed the shot. However, both types of ejectors require some form of mechanism to urge the golf ball upward out of the top opening of the golf cup.

The devices found in the prior art have many disadvantages. One such disadvantage is that many utilize complicated mechanisms to urge the golf ball from the golf cup. In this respect, some ejectors include devices used to delay activation of the mechanism, including sensors and valves. In many cases, the ejectors utilize electrical energy to produce the force required to urge the golf ball upwardly out of the golf cup and to power the sensors. In view of the place in which these devices are used, batteries must be utilized to produce the required electrical energy. This can be both an inconvenience and can cause damage to the ejector if the batteries leak due to their exposure to the outdoor environment in which these devices are used. Furthermore, even with the complicated mechanisms incorporated in these ejectors, the user cannot choose the direction in which the golf ball will be projected and the mechanisms are not capable of projecting the golf ball more than a few feet from the golf cup. In this respect, the prior art devices use vertical motion which is co-axial with the cylindrical side walls of the golf cup to urge the golf ball upward. This linear motion in the vertical direction is not well suited for producing the horizonal forces required to direct the golf ball away from the golf cup.

U.S. Pat. No. 3,623,732 to Peeples discloses a golf ball ejector device which attempts to direct the projection of the golf ball out of the cup. However, the disclosed device still utilizes vertical motion to urge the golf ball out of the golf cup. Accordingly, even though the upper end of the ejector includes an angled surface with respect to the longitudinal axis of the ejector, the amount of sideways force is much smaller than the corresponding vertical forces. Therefore, sideways movement of the ball is minimal.

U.S. Pat. No. 5,674,131 to Forbes discloses a golf cup novelty apparatus which utilizes a compression spring to urge an upper portion upwardly relative to a telescopically received base portion. As discussed above, the vertical linear motion of the '131 device urges the golf ball mainly in the upward direction with minimal sideways motion. As a result, the golf ball remains close to the golf cup after the device has been actuated. In an attempt to produce some sideways motion, Forbes increased the clearance in the telescopic engagement between the upper and base portions so that there is a "sloppy fit" therebetween. This allows for enough sideways motion to prevent the ball from falling back into the cup. Even though the '131 device, is intended to be portable, the telescopic design and the compression spring of this device prevents it from being easily compacted for storage. Another disadvantage is that the actuation of the '131 device is controlled by a rod guided within a "T" slot, wherein the ejector is held in a condition merely by the engagement between the rod and the T-portion of the "T" slot. The shock of the golf ball against the upper portion is intended to release the rod from the T-portion of the "T" slot. so that the upper portion is urged vertically relative to the base portion by the compression spring. This method of actuating the device can be unpredictable and unreliable.

SUMMARY OF THE INVENTION

In accordance with the present invention, an improved novelty golf ball ejector is provided for advantageously ejecting a golf ball from a golf cup in a manner which promotes reliable actuation without complicated mechanisms, and effectively projects the golf ball away from the golf cup in a selected direction. Further, the golf ball ejector is easily positionable within the cup and readily compactable for storage within the pocket of a golf bag. In this respect, a novelty golf ball ejector is provided which comprises an ejector plate which pivots relative to a base plate to project the golf ball out of the golf cup with both vertical and horizontal components of force. In one embodiment, actuation of the ejector plate is facilitated by a torsion spring which is connected between the ejector plate and the base plate, and reliability is increased by utilizing sloped surfaces on both the base plate and ejector plate for guiding the golf ball. In another embodiment, a centering member is used to center the golf ball ejector in a golf hole. In one aspect of this embodiment, the centering member is retractable relative to the base plate to allow the golf ball ejector to be easily compacted into a small portable overall configuration for easy storage within the pocket of a golf bag.

It is thus a principal object of the present invention to provide an improved novelty golf ball ejector which utilizes a torsion spring to produce the force required to eject a golf ball away from a golf cup.

It is another object of the present invention to provide an improved golf ball ejector having an ejector plate which pivots relative to a base plate to eject the golf ball from the golf cup.

Still another object of the present invention is to provide an improved golf ball ejector which utilizes sloped surfaces on both the base plate and ejector plate which, in connection with the cylindrical side walls of the golf cup, ensure that the golf ball engages the actuating mechanism.

It is another object of the present invention to provide a centering guide which properly positions the golf ball ejector in a golf hole and facilitates in maintaining the golf ball ejector in the proper position in the golf hole.

Yet still another object of the present invention is to provide a retractable centering guide to allow easy storage of the golf ball ejector within the pocket of a golf bag.

Still yet another object of the present invention is to provide a golf ball ejector which is reliable in that it will eject the golf ball out and away from the golf cup each time a golf ball enters the golf cup.

Another object of the present invention is to provide a golf ball ejector that allows the user to control the direction of the projected golf ball.

Still yet another object of the present invention is to provide a golf ball ejector which produces sufficient amounts of horizontal forces to move the golf ball away from the golf cup.

These and other objects of the invention will become apparent to those skilled in the art upon reading and understanding the following detailed description of the embodiment.

BRIEF DESCRIPTION OF THE DRAWINGS

The foregoing objects, and others, will in part be obvious and in part be pointed out more fully hereinafter in conjunction with the written description of the preferred embodiment of the invention illustrated in the accompanied drawings in which.

DESCRIPTION OF THE PREFERRED EMBODIMENT

Figure 1:
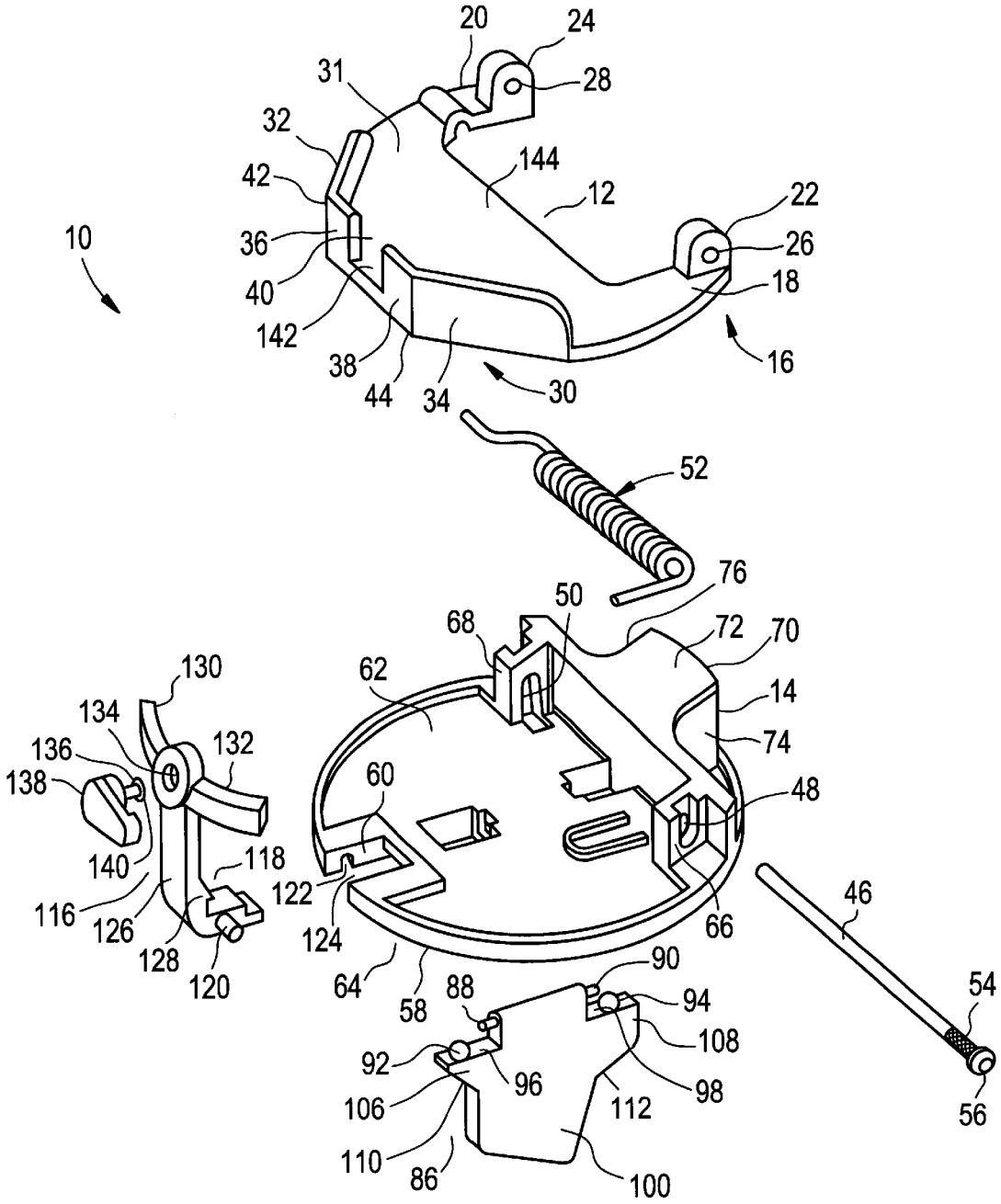
FIG. 1 is an exploded perspective view of a novelty golf ball ejector in accordance with the present invention.
Figure 2:
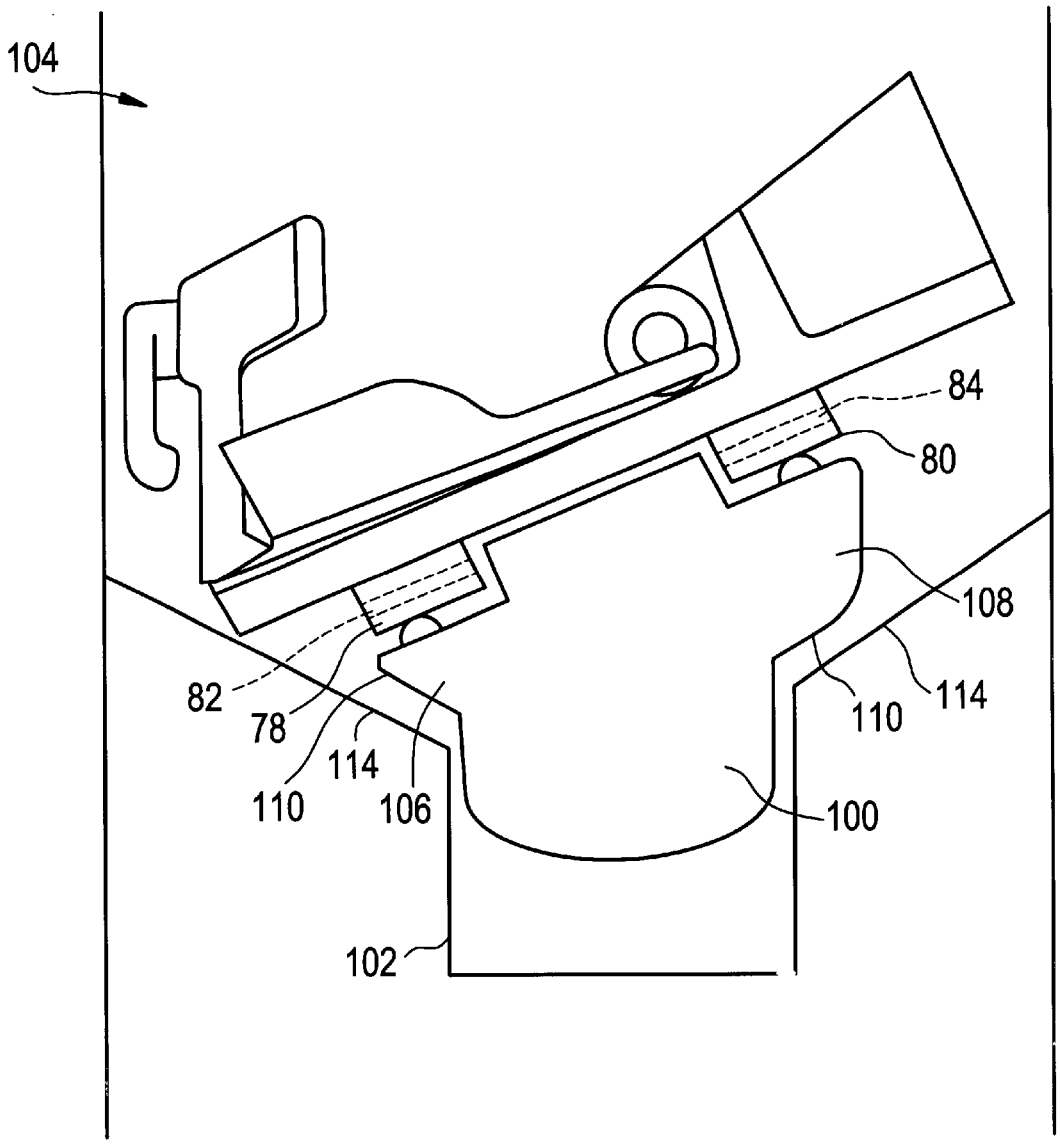
FIG. 2 is a side elevation view of the golf ball ejector illustrated in FIG. 1 within a golf cup.

Referring now in greater detail to the drawings wherein the showings are for the purpose of illustrating the preferred embodiment of the invention only, and not for the purpose of limiting the same, FIGS. 1 and 2 illustrates a novelty golf ball ejector 10 comprising an ejector plate 12 and a base plate 14.

Ejector plate 12 has a pivoting end 16 which includes extension arms 18, 20 that respectively include pivot housings 22, 24. Through hole 26 is within housing 22, and through hole 28 is within housing 24 and is coaxial with through hole 26. Ejector plate 12 further includes projecting end 30 which guides the golf ball out of the golf cup when the ejector 10 is actuated. Projecting end 30 includes upwardly facing surface 31 and side flanges 32, 34 along with end flanges 36, 38. End flanges 36, 38 are separated by latch opening 40. While end flanges 36, 38 are generally parallel to one another, side flanges 32, 34 are tapered inwardly toward end flanges 36, 38 so that when the golf ball encounters ejection plate 12, it is guided towards latch opening 40. Typically, the distance between edge 42 of side flange 32 and edge 44 of side flange 34 is such that when the golf ball is guided by side flanges 32 and 34, it is generally centered about latch opening 40.

Ejector plate 12 is pivotally connected to base plate 14 by shaft 46. Shaft 46 penetrates holes 26 and 28 of ejector plate 12 and holes 48, 50 of base plate 14 which allows ejector plate 12 to rotate relative to base plate 14 about pivoting end 16. Relative rotation of ejector plate 12 away from base plate 14, which projects the golf ball out of the golf cup, is produced by the mechanical energy of torsion spring 52 held in place by shaft 46. Shaft 46 includes knurled portion 54 and head portion 56 to secure shaft 46.

Base plate 14 has a circular peripheral edge 58 which includes cut out portion 60. Base plate 14 further includes a top portion 62 and a bottom portion 64. Pivot housings 66, 68 house holes 48, 50 respectively as discussed above. Top portion 62 further includes guiding portion 70 that has a sloped top surface 72 for guiding the golf ball onto ejector plate 12. Top portion 62 also includes finger grip edges 74, 76 for helping the user grasp the ejector for removal from the golf cup respectively. As can be appreciated, top portion 62 can be designed without finger grip edges. Bottom portion 64 is generally planar and includes pivot housings 78, 80 having through holes 82, 84 respectively.

Centering member 86 is connected to bottom portion 64 by shafts 88, 90 which allow centering member 86 to pivot relative to bottom portion 64 of base plate 14 between an operating position and a retracted position. As can be appreciated, center member 86 can be mounted so as not to pivot. Tensioners 92, 94 are provided on top edges 96, 98 respectively to maintain centering member 86 in either the operating position or the retracted position by the interference with pivot housings 78, 80. Centering member 86 further includes extending portion 100 which is sized to fit within centered hole 102 of golf cup 104. Centering member 86 further includes side extensions 106 and 108 having tapered bottom edges 110, 112 respectively. Golf cup 104 includes a conical bottom portion 114 surrounding and coaxial with centered hole 102. Tapered bottom edges 110 and 112 are angled for parallel engagement with bottom portion 114 of golf cup 104 to maintain ejection 10 at the proper angle.

Latch lever 116 is pivotally interengaged with base plate 14 by the respective engagement of shafts 118, 120 in holes 122, 124. Latch member 116 includes a vertical arm 126 having an inwardly facing catch 128. Horizontal arm 130 and opposing horizontal arm 132 extend from the top end of vertical arm 126 with through hole 134 centered therebetween to receive shaft 136 of safety latch 138. Barb 140 maintains the engagement of safety latch 138 with latch member 116 while allowing rotation of safety latch 138 relative to latch member 116.

Referring to FIGS. 3–6, shown is ejector plate 12 which include three different methods of improving the wear characteristics of ledge 142 without significantly increasing the cost of golf ball ejector 10. In this respect, ledge 142 is an integral part of ejector plate 12. However, ledge 142 alone makes contact with inwardly facing catch 128 to maintain golf ball ejector 10 in the stand by condition. Once the golf ball engages latch member 116 inwardly facing catch 128 slides across ledge 142 until the engagement therebetween is released. Further, this sliding action is resisted by the spring force produced by spring 52 which must be great enough to launch the golf ball out of the golf hole. Accordingly, this results in wear between the ledge 142 of ejector plate 12 and the inwardly facing catch 128 of latch member 116. While it is advantageous to make ejector plate 12 out of plastic for both cost reasons and weight reasons, ledge 142 is subjected to sufficient frictional forces to require either abrasion resistant plastics or metals to provide sufficient life expectancy of golf ejector 10. However, the use of such materials disadvantageously adds to the cost of the golf ball ejector and adds weight to ejector plate 12 which must freely move to project the golf ball out of golf cup 104. Accordingly, wear plates are utilized to increase the strength of ledge 142 without significantly adding to the cost or weight of ejector plate 12.

Figure 3:
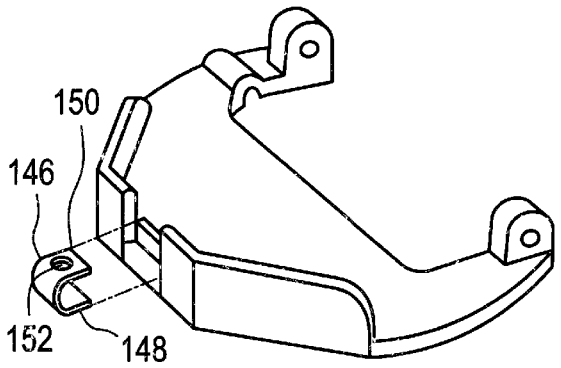
FIG. 3 is a perspective view of the ejector plate of the golf ball ejector illustrated in FIG. 1 which includes a C clip wear plate.

FIG. 3 shows a C clip 146 style wear plate on ledge 142. C clip 146 includes a bottom leg 148 and a top leg 150 which interengages with ledge 142 to maintain C clip 146 about ledge 142. Barb 152 ensures that C clip 146 retains its position on ledge 142 by resisting the movement of C clip 146 away from ledge 142. C clip 146 can be made from many different types of material, including metals and high strength plastics. As a result, ejector plate 12 can be made from low cost and light weight plastics, while more expensive and better wear resistant materials can be utilized at the wear point of ledge 142.

Figure 6:
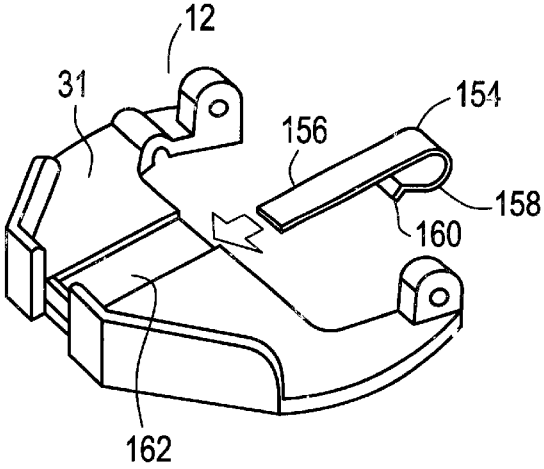
FIG. 6 is an exploded perspective view of the ejector plate of the golf ball ejector shown in FIG. 1 which includes a bent spring tab style wear plate.

Referring to FIG. 6, a bent spring tab style wear plate 154 is shown which also clips onto ejector plate 12 to increase the wear characteristics of ledge 142; however, spring clip 154 clips onto ledge 144 and extends across top surface 31 of ejector plate 12 to ledge 142. By engaging ledge 144 instead of ledge 142 to maintain the position of spring clip 154, a flat surface engagement with inwardly facing catch is produced, since spring clip 154 does not have to wrap around ledge 142. Spring clip 154 includes top extension leg.156 and curved bottom leg 158. Further, bottom leg 158 can include ramp portion 160 to aid in the installation of the spring clip 154. In order to maintain a smooth top surface 31, ejector plate 12 can be provided with recess 162 extending between ledge 142 and ledge 144 which has a width corresponding to the width of spring clip 154 and a depth corresponding to the thickness of spring clip 154.

Figure 4:
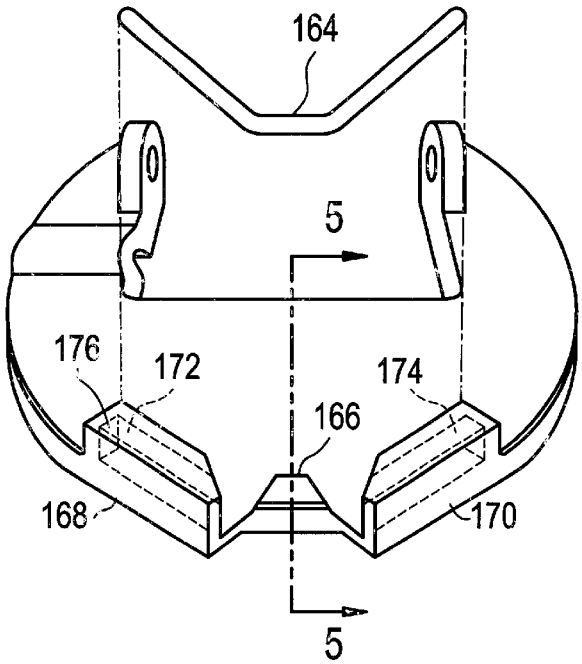
FIG. 4 is an exploded front perspective view of the ejector plate of the golf ball ejector illustrated in FIG. 1 which includes a wire wear plate.
Figure 5:
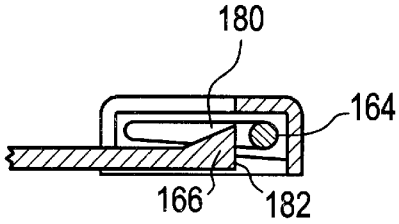
FIG. 5 is a sectional view from FIG. 4.

Referring to FIGS. 4 and 5, a wire style wear plate 164 is shown. As with the wear plates described above, wire style wear plate 164 can be made from virtually any material that has good wear characteristics which includes, but is not limited to, high wear resistant plastics and most metals. However, wire style wear plate 164 differs from the wear plates 146 and 154 in that it does not utilize a ledge to maintain its position relative to ejector plate 12. Conversely, wire style wear plate 164 maintains its position relative to ejector plate 12 by the engagement between catch 166 and modified upwardly facing side flanges 168 and 170. Further, upwardly facing end flanges similar to end flanges 36 and 38 have been eliminated. However, it should be noted that end flanges 36 and 38 could be utilized in this configuration. Modified upwardly facing side flanges 168 and 170 include wire pockets 172 and 174 respectively. Wire pockets 172 and 174 have a width and height slightly larger than wire style wear plate 164 and further include end surfaces 176 and 178 respectively. As a result, wire style wear plate is maintained between catch 166, wire pockets 172 and 174 and end surfaces 176, 178 and selective engagement with inwardly facing catch 128 is possible in the stand by condition.

Referring to FIG. 5, installation of wire style wear plate 164 is facilitated by ramp surface 180 of catch 166. In this respect, as wire style wear plate 164 is moved towards its operating position adjacent ledge 142, it engages ramp surface 180 of catch 166 before it enters spring pockets 172 and 174. Wear plate 164 is then flexed over ledge 166 until it is seated within spring pockets 172 and 174 and is prevented from disengagement by vertical surface 182 of catch 166. In this position, inwardly facing catch 128 will engage wire style wear plate 164 when in the stand by condition.

Referring to FIG. 2, golf ball ejector 10 is shown in the stand-by condition. In this respect, ejector 10 is prepared to project the golf ball out of the cup 104 when actuated by the presence of the golf ball within the cup 104. Ejector 10 is placed in standby condition by rotating ejector plate 12 relative to base plate 14 such that projection end 30 moves toward base plate 14 and torsion spring 52 is energized. Once ejector plate 12 is adjacent base plate 14, latch member 116 is pivoted toward base plate 14 until inwardly facing catch 128 engages ledge 142 of latch opening 40. The interengagement between catch 128 and ledge 142 maintains ejector plate 12 relative to base plate 14 until the golf ball ejector 10 is actuated by the engagement of the golf ball, which forces the latch member 110 to pivot outwardly until catch 128 is released from ledge 142.

In the stand by condition, ejector 10 can be easily placed within cup 104. This is facilitated by use of centering member 86 which properly orients ejector 10 within cup 104. In this respect, centering member 86 is first rotated relative to bottom portion 64 of base plate 14 until it is perpendicular thereto. Centering member 86 is maintained in this position by the interference between tensioners 92 and 94 and pivot housings 78 and 80 respectively. Centering member 86 is then positioned such that extending portion 100 penetrates centered hole 102 of cup 104. The proper slope of top surface 72 and ejector plate 12 is maintained by the parallel engagement between conical portion 114 of cup 104 and tapered bottom edges 110 and 112, hence, ejector 10 can quickly and easily be installed in cup 104 without concern for proper orientation. As a result, no matter how the golf ball enters cup 104, it is directed toward latch member 116 by the properly oriented sloped surfaces of base plate 14 and ejectorplate 12.

To ensure that the golf ball actuates latch member 116, upwardly facing side flanges 32 and 34 are tapered inwardly toward latch member 116. Further, latch 116 includes horizontal arms 130 and 132 extending therefrom to increase the engaging surface of latch 116. Accordingly, no matter how the golf ball enters cup 104, it is directed towards latch 116 for engagement therewith. Then, by its weight, the golf ball will pivot latch 116 away from ejector plate 12 thereby disengaging catch 128 from ledge 142. As a result, the energy stored in torsion spring 52 is released causing ejector plate 12 to quickly pivot relative to base plate 14. The golf ball then moves with ejector plate 12 by its engagement between top surface 31 and upwardly facing side and end flanges 32, 34, 36, 38 until it is projected out of cup 104 in the general direction of the rotation of ejector plate 12. Furthermore, the rotational movement of ejector plate 12 causes the golf ball to not only move upwardly, but to also move horizontally away from cup 104.

Golf ball ejector 10 is also collapsible for convenient storage within a golf bag. In this respect, centering member 86 is generally planar and as discussed above, can be rotated relative to bottom portion 64 of base plate 14. Once centering member 86 is substantially parallel to bottom portion 64, its extension beyond bottom portion 64 is minimal. Tensioners 92, 94 maintain this folded position relative to bottom portion 64. With respect to ejector plate 12, safety latch 138 can be utilized to securely maintain ejector plate 12 adjacent to the base plate 14 similar to its position in the standby condition. More particularly, latch member 116 is pivoted toward base plate 14 until it is adjacent to top portion 62. Next, ejector plate 12 is pivoted toward top portion 62 until it is adjacent to latch 116. This compact position is then maintained by rotating safety latch 138 relative to latch 116 until it interengages with ledge 144 of ejector plate 12. The stored energy within torsion spring 52 maintains the interengagement between safety latch 138 and ledge 144. Accordingly, when centering member 86 is adjacent bottom portion 64 and ejector plate 12 is adjacent top portion 62, ejector 10 can be easily stored in a small pocket of a golf bag or in the user's pant pocket.

The ejection of the golf ball can also be accompanied by noise making features and/or light generating features. In this respect, when ejector plate 12 is urged away from base plate 14 and/or when latch member 116 is disengaged from ledge 142, a sound producing element, such as, but not limited to, a battery powered buzzard can be activated. In the same respect, the movement of ejector plate 12 and/or latch member 116 could cause the activation of a light and/or other device which could be used to obtain a reaction in an opposing golfer.

While considerable emphasis has been placed on the preferred embodiment of the invention, illustrated and described herein, it will be appreciated that other embodiments can be made and that many changes can be made in the preferred embodiment without departing from the principals of the invention. Accordingly, it is to be distinctly understood that the foregoing descriptive matter is to be interpreted merely as illustrative of the invention and not as a limitation.

It is claimed:

1. A novelty golf ball ejector for ejecting a golf ball from a golf course cup with a cylindrical side wall, a top opening and a bottom portion with a centered hole, said golf ball ejector comprising: a base plate having a top surface for guiding the golf ball onto an ejector plate, said ejector plate being pivotally interengaged with said base plate for ejecting the golf ball out of the top opening of the cup when the golf ball is in an ejection position on said ejector plate, said golf ball ejector further comprising means for actuating said ejector plate when the golf ball is in said position.

2. The golf ball ejector of claim 1, wherein said base plate has a circular peripheral edge spaced from the cylindrical side wall of the cup.

3. The golf ball ejector of claim 1, wherein said ejector plate has a pivoting end and an opposing projecting end, said pivotal interengagement being on said pivoting end.

4. The golf ball ejector of claim 3, wherein said projecting end includes at least one upwardly facing flange.

5. The golf ball ejector of claim 1, wherein said actuating means includes a torsion spring between said ejector plate and said base plate.

6. The golf ball ejector of claim 5, wherein said actuating means further includes a lever pivotally connected to said base plate and selectively interengageable with said ejector plate to maintain said ball ejector in a stand by condition wherein said ball ejector is in position to eject the golf ball.

7. The golf ball ejector of claim 6, wherein said ejector plate is made from a plastic material and includes a wear plate for said selective interengagement with said lever.

8. The golf ball ejector of claim 5, wherein said top surface includes a sloped portion for guiding the ball onto said ejector plate.

9. The golf ball ejector of claim 8, wherein said base plate further includes a downwardly facing bottom portion and said golf ball ejector further comprises a centering member pivotally interengaged with said base plate bottom portion such that said centering member pivots relative to said base plate between an operating position wherein said member engages the center hole of the cup to center said ball ejector within the cup, and a retracted position wherein said member is generally parallel with said base plate bottom portion for easy storage of said ball ejector.

10. The golf ball ejector of claim 9, wherein said centering member is substantially planar and includes an extended portion for penetrating the centered hole of the cup and at least one tapered portion for engaging the cup bottom portion, thereby centering said golf ball ejector within the cup and producing said sloped portion.

11. The golf ball ejector of claim 10, wherein said ejector plate has a pivoting end and an opposing projecting end, said pivotal interengagement being on said pivotal end.

12. The golf ball ejector of claim 11, wherein said projecting end includes at least one upwardly facing flange.

13. The golf ball ejector of claim 1, wherein said base plate further includes a downwardly facing bottom portion and said golf ball ejector further comprises a centering member pivotally interengaged with said base plate bottom portion such that said centering member pivots relative to said base plate between an operating position wherein said member engages the center hole of the cup to center said ball ejector within the cup and a retracted position wherein said member is generally parallel with said base plate bottom portion for easy storage of said ball ejector.

14. The golf ball ejector of claim 13, wherein said centering member is substantially planar and includes an extended portion for penetrating the centered hole of the cup and at least one tapered portion for engaging the cup bottom portion, thereby centering said golf ball ejector within the cup and producing said sloped portion.

15. The golf ball ejector of claim 1, wherein said top surface includes a sloped portion for guiding the ball onto said ejector plate.

16. The golf ball ejector of claim 1, wherein said ball ejector further includes a noise maker which is activated by pivotal movement of said ejector plate relative to said base plate.

17. The golf ball ejector of claim 1, wherein said ball ejector further includes a light source which is activated by pivotal movement of said ejector plate relative to said base plate.

18. A novelty golf ball ejector for ejecting a golf ball from a golf course cup with a cylindrical side wall, a top opening and a bottom portion with a centered hole, said golf ball ejector comprising a base plate, an ejector plate which moves relative to said base plate for ejecting the golf ball out of the top opening of the cup when the golf ball is in an ejection position, and a torsion spring actively connected between said base plate and said ejector plate to produce said relative movement when the golf ball is in said position thereby ejecting the golf ball.

19. The golf ball ejector of claims 18, wherein said ejector plate is pivotally interengaged with said base plate and said golf ball ejector further includes means for actuating said relative movement of said ejector plate.

20. The golf ball ejector of claim 19, wherein said actuating means includes a lever pivotally connected to said base plate and selectively interengageable with said ejector plate to maintain said ball ejector in a stand by condition wherein said ball ejector is in position to eject the golf ball.

21. The golf ball ejector of claim 20, wherein said ejector plate is made from a plastic material and includes a wear plate for said selective interengagement with said lever.

22. The golf ball ejector of claim 18, wherein said base plate has a circular peripheral edge spaced from the cylindrical side wall of the cup.

23. The golf ball ejector of claim 19, wherein said ejector plate has a pivoting end and an opposing projecting end, said pivotal interengagement being on said pivoting end.

24. The golf ball ejector of claim 23, wherein said projecting end includes at least one upwardly facing flange.

25. The golf ball ejector of claim 18, wherein said base plate further includes a downwardly facing bottom portion and said golf ball ejector further comprises a centering member pivotally interengaged with said base plate bottom portion such that said centering member pivots relative to said base plate between an operating position wherein said member engages the center hole of the cup to center said ball ejector within the cup, and a retracted position wherein said member is generally parallel with said base plate bottom portion for easy storage of said ball ejector.

26. The golf ball ejector of claim 25, wherein said centering member is substantially planar and includes an extended portion for penetrating the centered hole of the cup and at least one tapered portion for engaging the cup bottom portion thereby centering said golf ball ejector within the cup and producing a sloped portion for guiding the golf ball into said ejection position.

27. The golf ball ejector of claim 18, wherein said base plate includes a top surface for guiding the golf ball onto said ejector plate.

28. The golf ball ejector of claim 27, wherein said top surface includes a sloped portion for guiding the golf ball onto said ejector plate.

29. A novelty golf ball ejector for ejecting a golf ball from a golf course cup with a cylindrical side wall, a top opening and a bottom portion with a centered hole, said golf ball ejector having a standby condition wherein said ball ejector is positioned to eject the golf ball out of the top opening of the cup when actuated by the golf ball and an actuated condition after the golf ball has been ejected from the cup, said ball ejector comprising a base plate and an ejector plate interengaged with said base plate for ejecting the ball, said base plate including a top surface having a first slope for guiding the golf ball onto the ejector plate and said ejector plate including a top surface having a second slope when in said standby condition for guiding the golf ball into an ejection position wherein said ball ejector is prepared to eject the golf ball, said first and second slopes being non-parallel.

30. The golf ball ejector of claim 29, wherein said base plate has a circular peripheral edge spaced from the cylindrical side wall of the cup.

31. The golf ball ejector of claim 29, wherein said ejector plate is pivotally interengaged with said base plate for pivotal movement relative to said base plate and for ejecting the golf ball out of the top opening of the cup when the golf ball is in said ejection position.

32. The golf ball ejector of claim 31, wherein said golf ball ejector further comprises means for actuating said ejector plate when the golf ball is in said ejection position which includes a torsion spring actively connected between said ejector plate and said base plate.

33. The golf ball ejector of claim 32, wherein said actuating means further includes a lever pivotally connected to said base plate and selectively interengageable with said ejector plate to maintain said ball ejector in said standby condition.

34. The golf ball ejector of claim 33, wherein said ejector plate is made from a plastic material and includes a wear plate for said selective interengagement with said lever.

35. The golf ball ejector of claim 29, wherein said base plate further includes a downwardly facing bottom portion and said golf ball ejector further comprises a centering member pivotally interengaged with said base plate bottom portion such that said centering member pivots relative to said base plate between an operating position wherein said member engages the center hole of the cup to center said ball ejector within the cup, and a retracted position wherein said member is generally parallel with said base plate bottom portion for easy storage of said ball ejector.

36. The golf ball ejector of claim 35, wherein said centering member is substantially planar and includes an extended portion for penetrating the centered hole of the cup and at least one tapered portion for engaging the cup bottom portion thereby centering said golf ball ejector within the cup and producing said first and second sloped surfaces.

37. A novelty golf ball ejector for ejecting a golf ball from a golf course cup with a cylindrical side wall, a top opening and a bottom portion with a centered hole, said golf ball ejector comprising: a base plate having a bottom portion and a top portion, an ejector plate interengaged with said base plate for ejecting the golf ball out of the top opening of the cup, and a centering member pivotally interengaged with said base plate bottom portion such that said centering member pivots relative to said base plate between an operating position wherein said member engages the centered hole of the cup to center the ball ejector within the cup and a retracted position wherein said member is generally parallel with said base plate bottom portion plate for easy storage of said ball ejector.

38. The golf ball ejector of claim 37, wherein said ejector plate is pivotally interengaged with said base plate for pivotal movement relative to said base plate and for ejecting the golf ball out of the top opening of the cup when the golf ball is in an ejection position.

39. The golf ball ejector of claim 37, wherein said golf ball ejector further comprises a torsion spring actively connected between said base plate and said ejector plate to move said ejector plate relative to said base plate.

40. The golf ball ejector of claim 37, wherein said ejector plate has a pivoting end and an opposing projecting end, said pivoting end being pivotally interengaged with said base plate for pivotal movement relative to said base plate and for ejecting the golf ball out of the top opening of the cup when the golf ball is in an ejecting position.

41. The golf ball ejector of claim 36, wherein said projecting end includes at least one upwardly facing flange.

42. The golf ball ejector of claim 36, wherein said base plate has a circular peripheral edge spaced from the cylindrical side wall of the cup.

43. The golf ball ejector of claim 40, wherein said ball ejector further includes a noise maker which is activated by said pivotal movement.

44. The golf ball ejector of claim 40, wherein said ball ejector further includes a light source which is activated by said pivotal movement.

* * * * *